US006099412A

United States Patent [19]

Weibye

[11] Patent Number: 6,099,412

[45] Date of Patent: Aug. 8, 2000

[54] FLEXIBLE DISTANCE MARKER FOR GOLF COURSE

[76] Inventor: Ronald Weibye, R.R. 1, Box 117, Eagle Bend, Minn. 56446

[21] Appl. No.: 09/189,208

[22] Filed: Nov. 10, 1998

[51] Int. Cl.[7] ..... A63B 57/00; E01F 9/011

[52] U.S. Cl. ..... 473/150; 116/209; 40/608

[58] Field of Search ..... 473/150, 405; 40/608; 52/103; 116/209; 404/10, 11

[56] References Cited

U.S. PATENT DOCUMENTS

| | | | |
|---|---|---|---|
| 1,726,817 | 9/1929 | Franklin . | |
| 3,279,133 | 10/1966 | de Korte . | |
| 4,862,823 | 9/1989 | Hughes . | |
| 4,893,455 | 1/1990 | Hughes . | |
| 5,029,783 | 7/1991 | Alvarez | 40/608 |
| 5,052,329 | 10/1991 | Bennett | 116/209 |
| 5,066,163 | 11/1991 | Whitaker . | |
| 5,186,119 | 2/1993 | Hlavin | 116/209 |
| 5,205,236 | 4/1993 | Hughes | 116/209 |
| 5,215,033 | 6/1993 | Gipp et al. . | |
| 5,247,900 | 9/1993 | Sobczak . | |
| 5,441,257 | 8/1995 | Sheaffer . | |
| 5,607,153 | 3/1997 | Bailey | 473/150 |
| 5,879,248 | 3/1999 | Maarsico . | |

*Primary Examiner*—Steven Wong
*Attorney, Agent, or Firm*—Nikolai, Mersereau & Dietz, P.A.

[57] ABSTRACT

A flexible marker system includes a cup member having an aperture centered in its base through which a stake is inserted. The anchor has a tapered stem with two triangular anchor plates extending from the tapered stem. A flexible hinge has two opposing cylindrical members, one for receiving the upper end of the stake and the other for receiving the lower end of a rod. The hinge deflects in all directions. The rod extends upward from the hinge and is colored to indicate distance. A greens mower can approach the flexible marker system from any direction. When the mower encounters the rod, the rod will deflect via the flexible hinge to a position substantially flush with the ground surface. Once the mower has passed the flexible marker system, the rod will return to an upright position.

5 Claims, 6 Drawing Sheets

FLEXIBLE DISTANCE MARKER FOR GOLF COURSE

BACKGROUND OF THE INVENTION

I. Field of the Invention

The present invention relates to a flexible distance marker for use on golf courses, and more particularly to a distance marker capable of deflection when contacted by a golf course greens mower and then returning to an upright position once the mower has passed.

II. Related Art

Golf course groundskeepers work diligently to keep the golf course in exceptional playing condition. Part of the maintenance includes mowing the course every day or every other day. In an attempt to shorten the mowing time, flexible distance markers have been developed, such as that disclosed in U.S. Pat. No. 4,893,455 to Hughes. Such markers are positioned on a flexible shaft that bends as the mower passes over the marker. This eliminates the need for the groundskeeper to stop the mower, get down from the mower, remove the marker, mow over the marker area, stop the mower, go off the mower and replace the marker. However, repeated flexing damages the markers over time and the grass surrounding the flexible marker may not be cut evenly, an undesirable result in golf course management.

Another approach is to position distance markers on stakes placed in the rough on the sides of the fairway. These stakes are not always readily visible, especially at a distance. Flat discs, with the distance indicated thereon and placed on the fairway flush with the ground, are also used even though the distance marking is not readily visible to the golfer. A golfer without distance information is at a disadvantage because such information is helpful when selecting the proper club for the next shot and for informing the golfer the distance achieved on the previous shot.

In an attempt to address the need for a reliable flexible marker, U.S. Pat. No. 5,441,257 to Sheaffer discloses a recessed plate secured by two stakes and supporting a marker flexibly secured in a recess of the plate. The use of two stakes to secure the plate is time consuming and the parts can be easily misplaced. Thus, what is needed is a flexible golf course marker that is compact yet prevents damage to the marker as it is passed over by a greens mower.

Thus, the primary object of the present invention is to provide a simple flexible golf course distance marker with minimal parts that will withstand repeated contact with a greens mower and be readily viewed by golfers.

Another object of the present invention is to provide a flexible golf course distance marker that will deflect in all directions and is resilient such that the marker will deflect as a greens mower passes over and then return to an upright position enabling golfers to see the marker.

SUMMARY OF THE INVENTION

In accordance with the present invention, a flexible distance marker is provided with a stake for inserting into the ground to secure the marker. The marker includes a cup-shaped member having an aperture in its lower surface through which the stake extends. The upper portion of the stake remains in the interior of the cup shape member. A hinge is mounted to the upper portion of the stake. A rod extends from the hinge and is colored to indicate the distance. The hinge allows the rod to pivot in all directions and to deflect until the rod is flush with the ground. Thus, a greens mower can approach the distance marker from any direction and pass over the marker. The marker will deflect as the mower passes over it and then the marker will return to its upright position once the mower is past.

BRIEF DESCRIPTION OF THE DRAWINGS

The foregoing features of the invention will become more readily apparent by referring to the following detailed description of the preferred embodiment, taken in conjunction with accompanying drawings in which.

DETAILED DESCRIPTION

Figure 1:
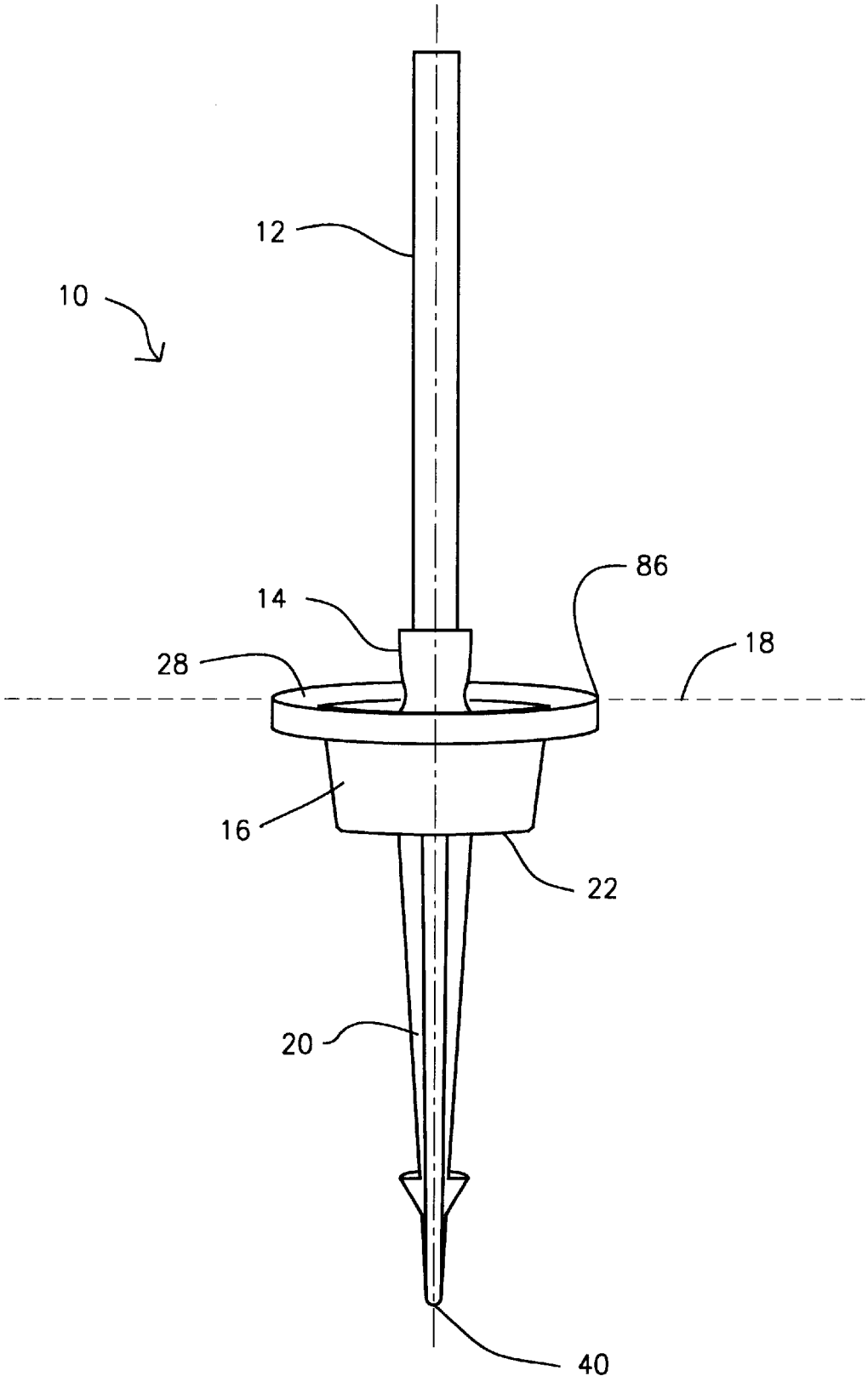
FIG. 1 is a perspective view of the flexible stake of the present invention with the ground surface shown in broken line.

Turning to FIG. 1, there is shown a flexible marker 10 of the present invention. The flexible marker 10 includes a rod 12. The rod 12 is seated in a hinge 14. Hinge 14 is mounted in a cup member 16 secured to the ground surface 18 with a stake 20. Rod 12 is color coded with the accepted colors designating distances on a golf course. Red denotes 100 yards, white denotes 150 yards and blue denotes 200 yards.

Figure 2:
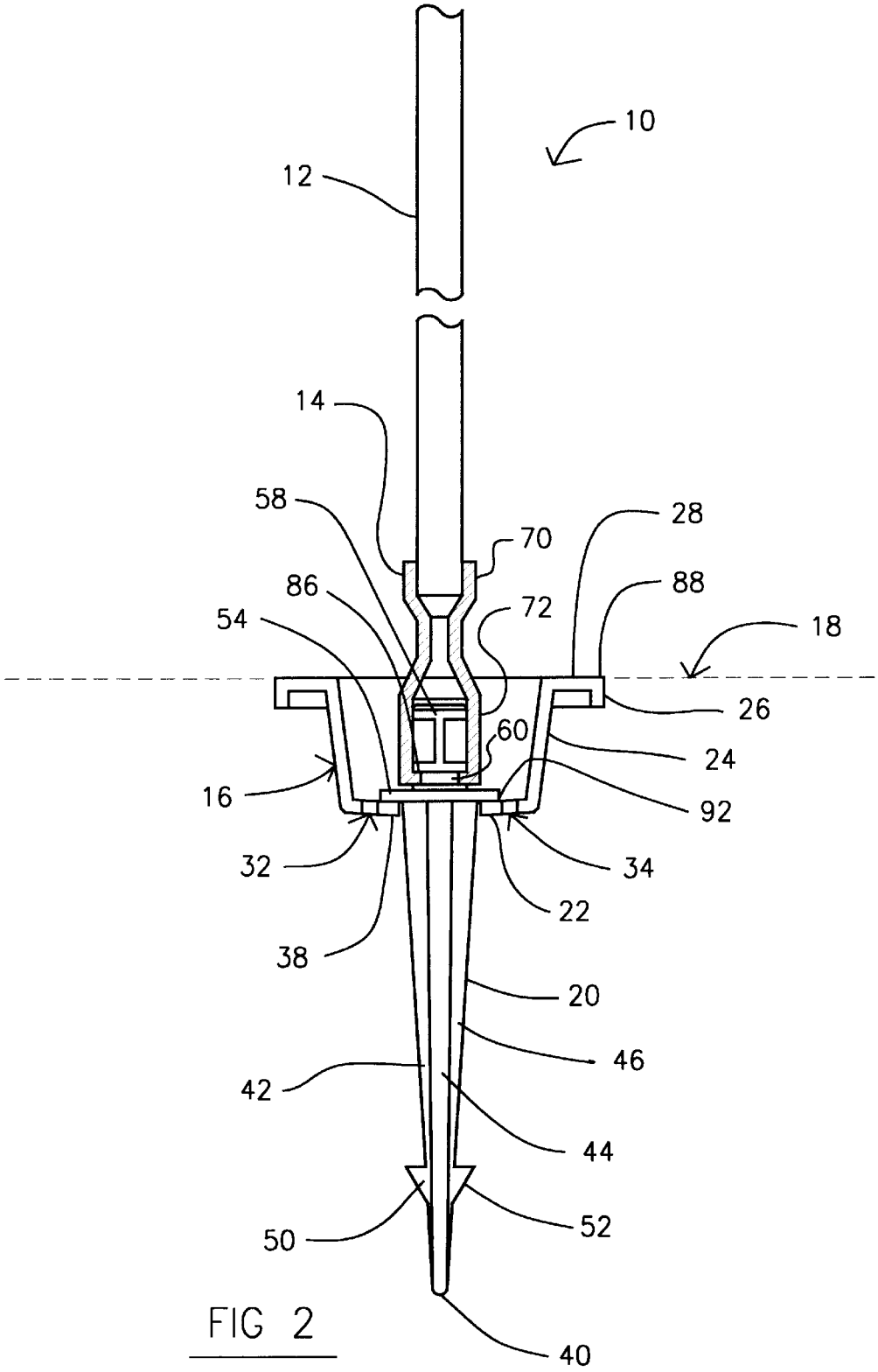
FIG. 2 is a cross-sectional view of the present invention, taken along line 2—2 of FIG. 1.
Figure 3:
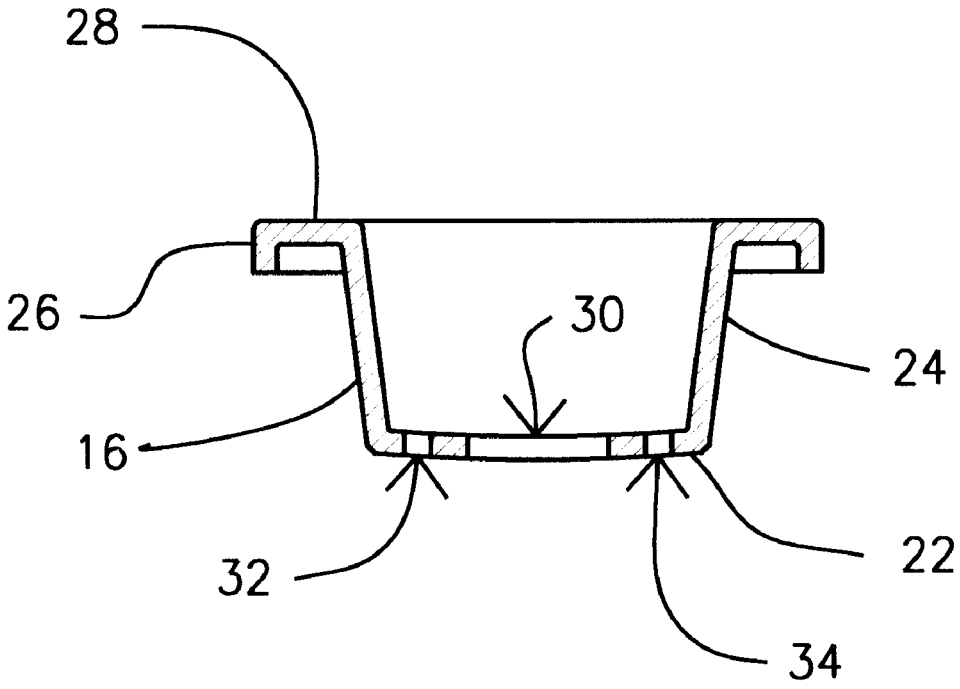
FIG. 3 is a cross-sectional view of the cup member of the present invention.
Figure 4:
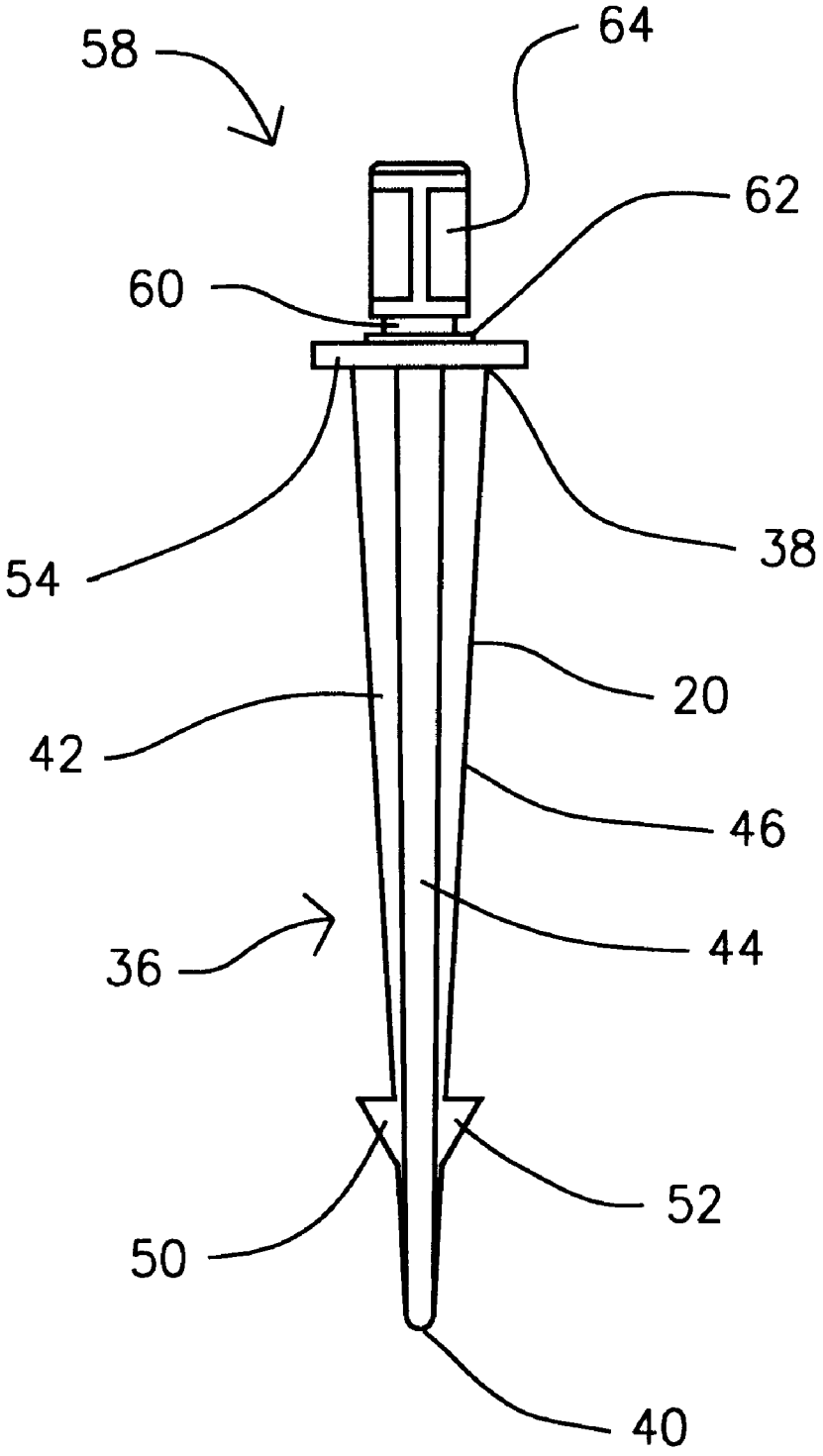
FIG. 4 is a front plan view of the stake and hinge mount arrangement of the present invention.
Figure 7:
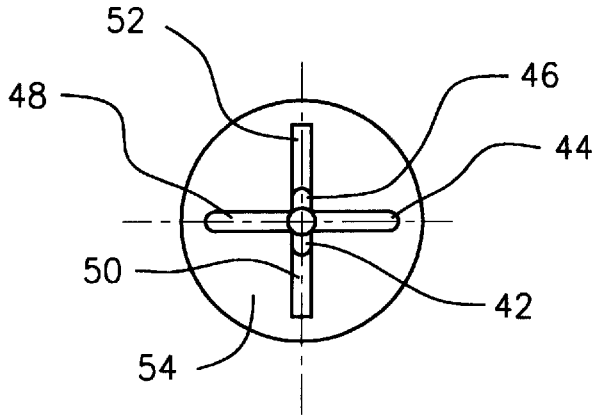
FIG. 7 is a bottom view of the stake of the present invention.
Figure 5:
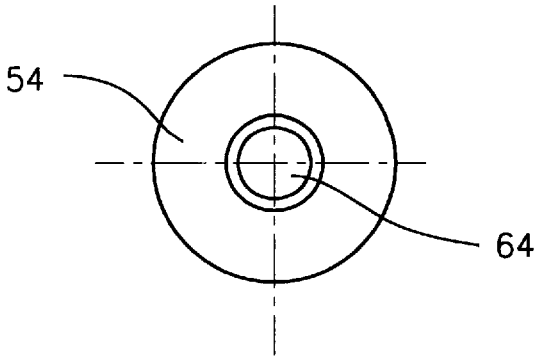
FIG. 5 is a top plan view of the stake and hinge arrangement of the present invention.
Figure 6:
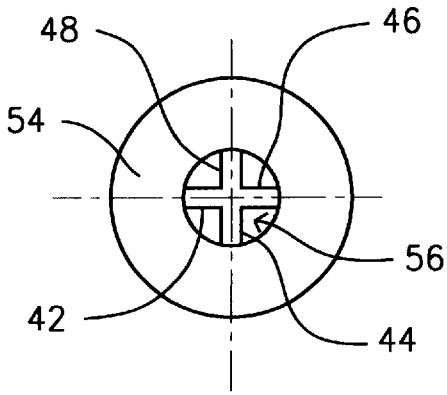
FIG. 6 is a top view of the stake of the present invention.

Cup member 16, shown in greater detail in FIGS. 2 and 3, has a circular shape with a base 22 and a side wall 24 that has a rim 26 forming the upper edge 28 of cup member 16. A central aperture 30 through which stake 20 can extend, along with at least two smaller apertures 32 and 34 surrounding aperture 30, are located in base 22. The cup depth is preferably approximately 1.5 inches and the outer diameter of rim 26 is preferably approximately 4.30 inches.

Turning now to FIGS. 4–7, stake 20 will be described. Stake 20 includes a stem 36 tapered from end 38 to end 40. Stem 36 is formed by four intersecting plates 42, 44, 46 and 48 having a central axis. Plate 42 includes a protruding triangular anchoring member 50. Likewise, plate 46 includes a protruding triangular anchoring member 52. Located at end 38 of the four plates is an annular plate 54 defining an aperture 56. A hinge mount 58 is formed from a neck 60 extending from a plate 62 positioned in aperture 56. Neck 60 has an enlarged mount member 64 with a diameter greater than the diameter of neck 60.

Figure 8:
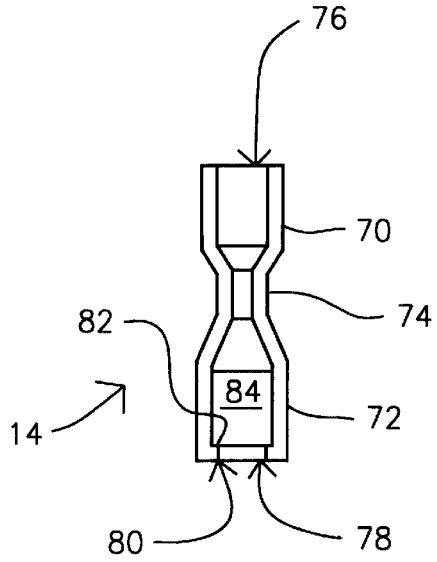
FIG. 8 is a cross-sectional view of the hinge of the present invention.

Hinge 14 is preferably a rubber, an elastomeric material or any other suitable flexible and resilient material. Hinge 14 consists of two opposing cylindrical members 70 and 72 joined at an intermediate stem 74 as seen in FIG. 8. Cylindrical member 70 has an open end 76 and is sized to receive rod 12 therein with preferably a press fit. Cylindrical member 72 is larger and is sized to fit over the mount member 64. Its open end 78 includes a rim 80 extending around the inner portion to form a lip 82 in an interior cavity 84. Hinge 16 is press fit over hinge mount 58. As seen in FIG. 2, Rim 80 extends over the bottom surface 86 of hinge mount 58 and contacts the outer surface of the hinge mount neck 60.

In use, the location of the marker 10 is determined and the cup member 16 is placed on the ground. If necessary, a slight depression is made to accommodate cup member 16 such that the upper surface 86 of rim 26 is substantially flush with the ground surface 18. Stake 20 is inserted through aperture 30 and into the ground until plate 54 is flush against the inside surface 92 of cup member base 22. The triangular anchoring members 50 and 52 further secure stake 20 in position in the ground. Apertures 32 and 34 act as drain holes for any water that may collect in the cup member 18. Additional apertures may be used for drainage purposes. Hinge 14 is then secured by pressing cylindrical member 72 over mount 58 until rim 80 snaps into place, surrounding the lower edge 88 of mount 58 and contacting the neck 60. Rod 12 is inserted into cylindrical member 70 with a press fit.

Figure 9:
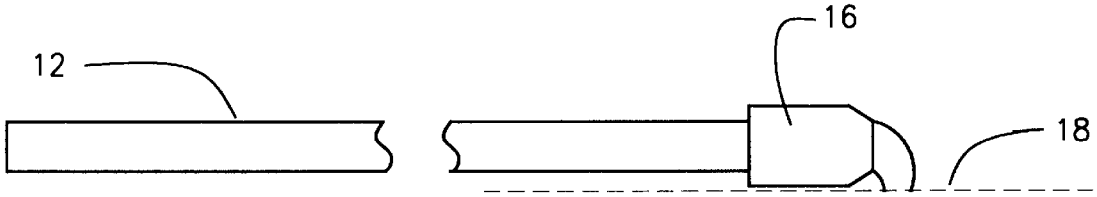
FIG. 9 is a side view of the present invention in a deflected position.

When the groundskeeper is mowing the greens, the distance marker can be encountered from any direction. When the mower contacts rod 12, hinge 14 bends into cup member 16, twisting to deflect, until it is substantially flush to the ground surface as seen in FIG. 9. This allows the mower to pass over rod 12. The cylindrical nature of the hinge 14 allows rod 12 and hinge 14 to bend in all directions. Once the mower has passed the marker 10, it will return to its upright position.

This invention has been described herein in considerable detail in order to comply with the Patent Statutes and to provide those skilled in the art with the information needed to apply the novel principles and to construct and use embodiments of the example as required. However, it is to be understood that the invention can be carried out by specifically different equipment and devices and that various modifications, both as to the equipment details and operating procedures can be accomplished without departing from the scope of the invention itself.

What is claimed is:

1. A flexible marker system comprising:

(a) a cup member having an upper rim for engaging the ground surface and a base with a first aperture centered in said base;

(b) a stake removeably extending through said first aperture, said stake having a first end for inserting into the ground and a second end for positioning within said cup member;

(c) a rod; and (d) a flexible rod mount selectively secured to said second end of said stake, said rod selectively mounted in said flexible rod mount, (e) said flexible rod mount includes a first cylindrical member selectively mounted on said second end of said stake and a second cylindrical member selectively supporting said rod;

(f) said second end of said stake comprising a neck and a flexible rod mount mounting member positioned on said neck, said neck having a diameter less than said flexible rod mount mounting member and said first cylindrical member having an open end with a lip extending around said open end, said lip defining a diameter less than said flexible rod mount mounting member, whereby said second cylindrical member receives said flexible rod mount mounting member with said lip contacting said neck.

2. A flexible marker system of claim 1 wherein said cup member further includes a second aperture in said base, said second aperture having a diameter less than said first aperture.

3. A flexible marker system of claim 1 wherein said stake includes a stem tapering from said second end to said first end.

4. A flexible marker system of claim 1 wherein said stake comprises four plates extending from a central axis.

5. A flexible marker system of claim 1 wherein said stake includes at least one anchor member extending from said stake.

* * * * *